United States Patent [19]

Watanabe

[11] Patent Number: 5,024,024

[45] Date of Patent: Jun. 18, 1991

[54] GRINDING AND FINISHING APPARATUS AND METHOD

[75] Inventor: Masaki Watanabe, Hachiohji, Japan

[73] Assignee: Olympus Optical Company Limited, Japan

[21] Appl. No.: 410,081

[22] Filed: Sep. 20, 1989

[30] Foreign Application Priority Data

Oct. 20, 1988 [JP] Japan ..... 63-265080

[51] Int. Cl.[5] ..... B24B 13/02

[52] U.S. Cl. ..... 51/124 L; 51/284 R

[58] Field of Search ..... 51/124 R, 124 C, 121, 51/35, 123 R, 60, 67, 284 R

[56] References Cited

U.S. PATENT DOCUMENTS

| | | | |
|---|---|---|---|
| 2,291,000 | 7/1942 | Simpson | 51/124 L |
| 3,842,713 | 10/1974 | Hamilton et al. | 51/124 L |
| 3,889,426 | 6/1975 | Blum | 51/124 L |
| 4,173,848 | 11/1979 | Ikeno | 51/124 R |
| 4,535,570 | 8/1985 | Ochiai et al. | 51/123 R |
| 4,584,799 | 4/1986 | Juvet | 51/284 R |
| 4,598,502 | 7/1986 | Lombard | 51/124 L |
| 4,768,308 | 9/1988 | Atkinson, III et al. | 51/124 L |

*Primary Examiner*—M. Rachuba

*Attorney, Agent, or Firm*—Bruce L. Adams; Van C. Wilks

[57] ABSTRACT

A grinding and finishing apparatus for mechanically working a workpiece by grinding and finishing process is desclosed. The apparatus comprises a workpiece carrying shaft for carrying a workpiece so as to rotatively drive or rotate it about its axis, a tool carrying shaft for carrying a tool on the same axis at that of the workpiece shaft and constituted so as to be capable of rotating and driving through a drive means, thereby grinding and finishing the workpiece to be worked by rotating the workpiece and the tool with each other, a mechanism for swinging the workpiece carrying shaft or the tool carrying shaft about an axis perpendicular to an axis thereof, a mechanism for translating the workpiece carrying shaft or the tool carrying shaft in the direction perpendicularly to an axis thereof in a plane including respective center lines of the both shafts, a mechanism for rectilinneally moving holders for the workpiece shaft and the tool shaft in its axial direction in accordance with the movement thereof, and a control unit for controlling the movement of the respective shafts and the holders.

18 Claims, 14 Drawing Sheets

GRINDING AND FINISHING APPARATUS AND METHOD

BACKGROUND OF THE INVENTION

The present invention relates to a grinding and finishing apparatus for mechanically working an optical element or the like by grinding and finishing processes and a method of grinding and finishing the optical element or the like. More particularly, the present invention relates to an apparatus for grinding and finishing a body to be worked (workpiece) which comprises a workpiece carrying shaft for holding a workpiece so as to rotatively drive or rotate it about its axis, and a tool carrying shaft for holding a tool on the same axis as that of the workpiece shaft and constituted so as to be capable of rotating and driving through a drive means, thereby grinding and finishing a workpiece to be worked by rotating the workpiece and the tool with each other, and a method of grinding and finishing the optical element.

The conventional grinding and finishing apparatus has been well known from a lens grinding or finishing apparatus described in Japanese Utility Model Application No. 13,439/68. As shown in FIGS. 7 and 8, such a lens grinding apparatus comprises a swinging or swivel frame 2 pivoted by or supported by horizontal shafts 1, 1, lower dish member supporting shaft 3 provided at right angles to the horizontal shafts and capable of controlling ascending and descending motion thereof, a crank plate member 4 connected to a swinging drive source, and a swinging arm member 11 having a guide slot 10. The swinging arm member 11 is, on the one hand, attached to the crank plate member 4 by a sliding member 6 engaged to an adjusting screw 5 arranged to the crank plate member 4 in a relation of screw pair or a setscrew 7, and is, on the other hand, attached to the horizontal shafts 1, 1 by a setscrew 9 through an arc shaped slot 8 so as to adjust its attached position. The swinging frame 2 may be swung around the shaft center of the horizontal shafts 1 by slidable connection of the setscrew 7 and the swinging arm member 11 so as to be capable of controlling its angular amplitude and its center position. An upper dish member supporting shaft 12 and a lower dish member supporting shaft 3 are arranged to make the upper dish member supporting shaft 12 ascending and descending operable above a lower dish 14, and then these supporting shafts 3 and 12 are rotated forcibly through a wrapping connector driving mechanism, so that a lens member 15 may be ground between an upper dish 13 and the lower dish 14.

According to the above lens grinding and finishing apparatus, the upper dish 13 and the supporting shafts 12 and 3, respectively, and the upper and lower supporting shafts 12 and 3 are rotated and the swinging frame 2 is swung, while providing the surface to be ground of the lens material 15 with abrasive, so that the lens material 15 may be ground.

The above conventional lens grinding apparatus has a working means for swinging the lower dish 14 with angular amplitude about an angular amplitude swinging center set on an axis of the lower dish supporting shaft 3, so that when the upper dish 13 is worked under the state fixed to the lower end of the upper dish supporting shaft 12, the working must be performed under the state corresponding the sphere center of the lower dish 14 to the angular amplitede swinging center of the lower dish supporting shaft 3, and thus a space of length corresponding to radius of curvature of the lower dish 14 must be provided above the lower dish supporting shaft 3, and thus it is very difficult to correspond the apparatus to various or whole radius, in practice.

In the above conventional lens grinding apparatus, it is also considered that the upper dish member 13 is not fixed to the lower end of the upper dish member supporting shaft 12 and is held so as to slant it to the upper dish supporting shaft 12 and thus to absorb the disagreement of the swinging shaft to the spherical center of the lower dish member 14. In this case, problems lie in that the angle between the upper dish supporting shaft 12 and the upper dish 14 becomes too large and the control of the working conditions becomes difficult.

SUMMARY OF THE INVENTION

It is an object of the present invention to overcome the above disadvantage of the conventional apparatus.

It is another object of the present invention to provide a grinding and finishing apparatus in which the surface to be worked of a workpiece having all radii of curvature from very small radius of curvature to a plane surface may be ground without coincidence of the sphere center of the lower dish with the angular amplitude swinging shaft.

It is a further object of the present invention to provide a grinding and finishing apparatus and a method in which a member having guide holes for the upper shaft may be moved vertically in accordance with a vertical motion of the upper shaft (workpiece shaft), so that it can be widely applied from a working for generating a spherical surface and a plane surface based on a maternal or generating principle to a working for grinding based on a copying or profiling work.

According to the present invention, there is provided a grinding and finishing apparatus comprising a workpiece carrying shaft for carrying a workpiece so as to rotatively drive or rotate it about its axis, a tool carrying shaft for carrying a tool on the same axis as that of the workpiece shaft and constituted so as to be capable of rotating and driving through a drive means, thereby grinding and finishing the workpiece to be worked by rotating the workpiece and the tool with each other, a mechanism for swinging the workpiece carrying shaft or the tool carrying shaft about an axis perpendicular to an axis thereof, and a mechanism for translating the workpiece carrying shaft or the tool carrying shaft in the direction perpendicularly to an axis thereof in a plane including the center lines of both shafts.

According to the present invention, there is also provided a grinding and finishing apparatus further comprising a mechanism for controlling an angular swinging and a rectilinear moving of the workpiece shaft and the tool shaft are controlled with each other in such a manner that the respective center lines of the workpiece shaft and the tool shaft intersect at all times in the sphere center of the workpiece shaft and the tool shaft each having the same radius of curvature.

A grinding and finishing apparatus comprising a workpiece carrying shaft for carrying a workpiece so as to rotatively drive or rotate it about its axis, a tool carrying shaft for carrying a tool on the same axis as that of the workpiece shaft and constituted so as to be capable of rotating and driving through a drive means, thereby grinding and finishing the workpiece to be worked by rotating the workpiece and the tool with each other, a mechanism for swinging the workpiece carrying shaft or the tool carrying shaft about an axis perpendicular to an axis thereof, a mechanism for translating the workpiece carrying shaft or the tool carrying shaft in the direction perpendicularly to an axis thereof in a plane including respective center lines of the both shafts, a mechanism for rectilinearly moving holders for the workpiece shaft and the tool shaft in its axial direction in accordance with the movement thereof, and a control unit for controlling the movement of the respective shafts and the holders.

According to the present invention, there is further provided a grinding and finishing method comprising a step of selecting a straight cup grinding wheel for grinding and generating a spherical surface or a plane surface of a workpiece and a dish grinding and finishing grinding wheel having a concave and convex spherical surface or a plane surface corresponding to the spherical surface or the plane surface of the straight cup grinding wheel, a step of selecting a rotating drive of a tool carrying shaft for holding the grinding wheel and a workpiece carrying shaft for holding the workpiece, and a step of setting a number control program, whereby workings from the generation to the grinding and finishing are performed in the same unit.

According to the present invention the grinding and finishing apparatus utilizes an angular amplitude swinging mechanism for swinging the workpiece shaft or the tool shaft according to demand, and a translating mechanism for the workpiece shaft and the tool shaft, so that the same grinding and finishing working as that due to the angular amplitude swinging about the sphere center of the workpiece or the tool, or a grinding and finishing work for a plane surface may be performed.

Also, the holders for the workpiece shaft or the tool shaft are moved in the axial direction in accordance with the workpiece shaft and the tool shaft which are moved vertically according to the angular swinging action of the tool at the grinding and finishing working. Therefore, the relative sliding action does not occur between the workpiece shaft or the tool shaft and its holders, so that the pressure force becomes always constant for the workpiece.

Furthermore, in the grinding and finishing method according to the present invention, workings from the grinding generation to the grinding and finishing due to the dish grinding wheel may be performed in the one and same apparatus.

DESCRIPTION OF THE PREFERRED EMBODIMENTS

Figure 1:
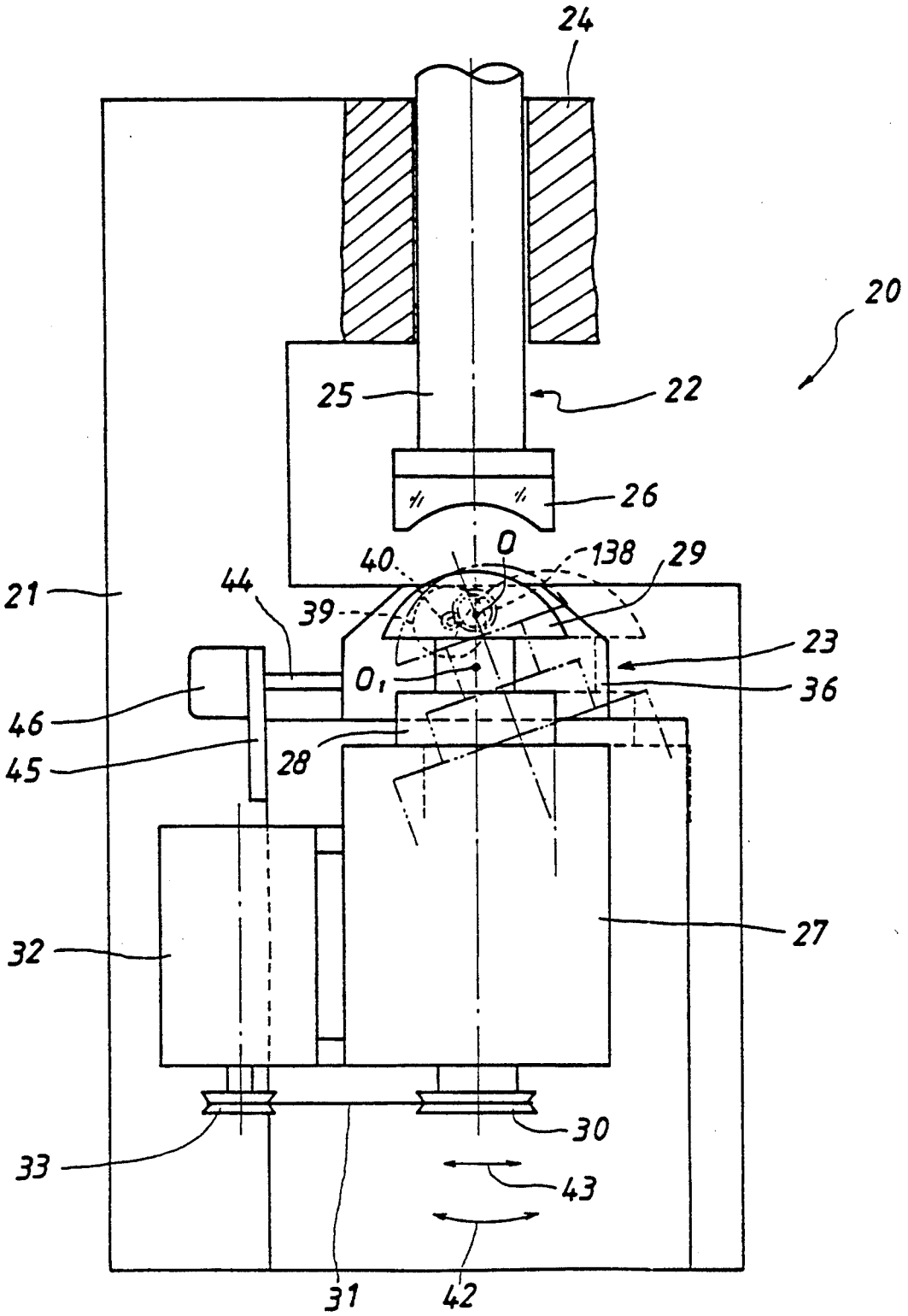
FIGS. 1*a* and 1*b* are side view and front view each showing a construction of one embodiment of a grinding and finishing apparatus according to the present invention.
FIGS. 1*c* and 1*d* are side view and front view each showing a construction in modification of the grinding and finishing apparatus according to the present invention.
Figure 1:
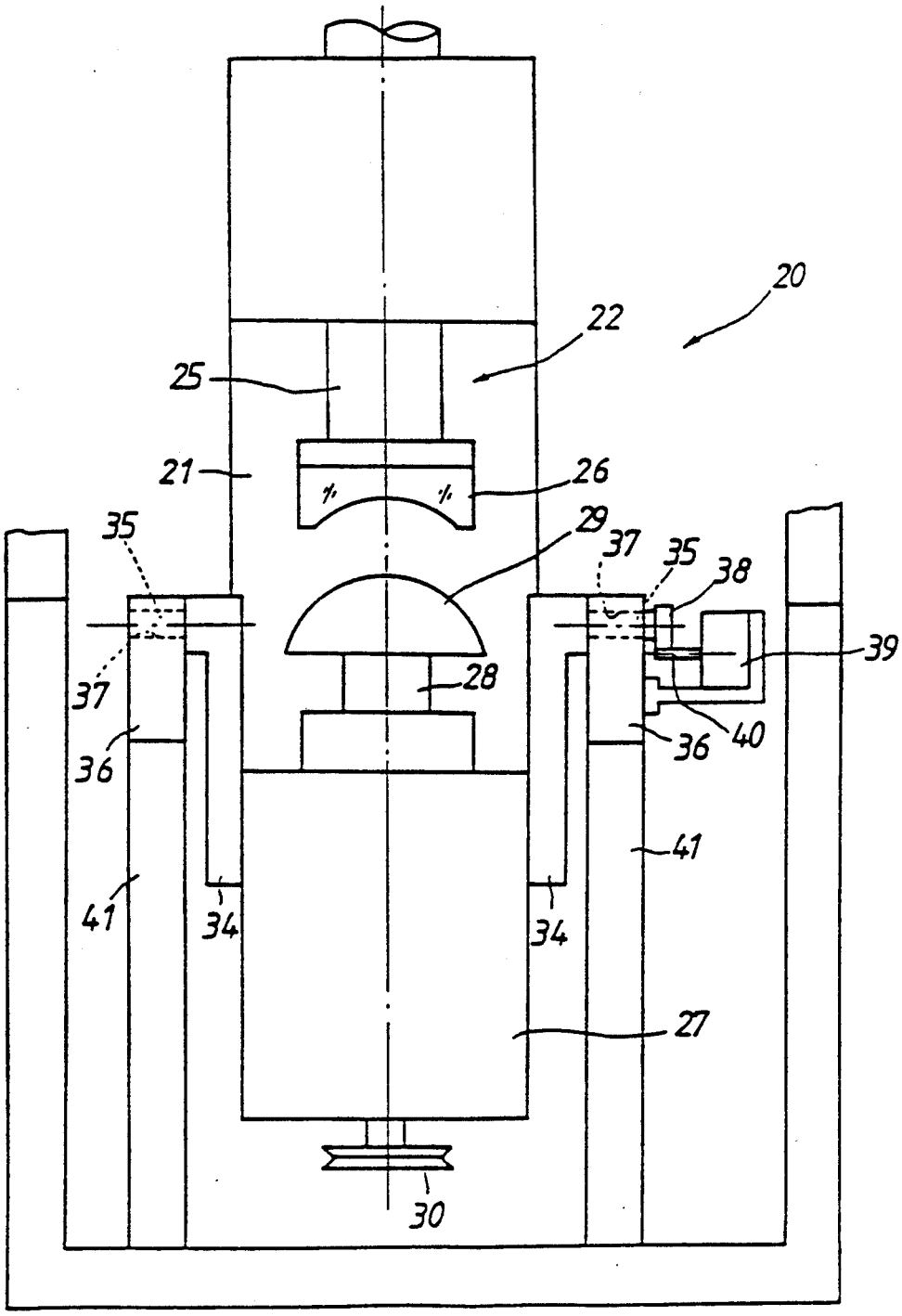
Figure 1:
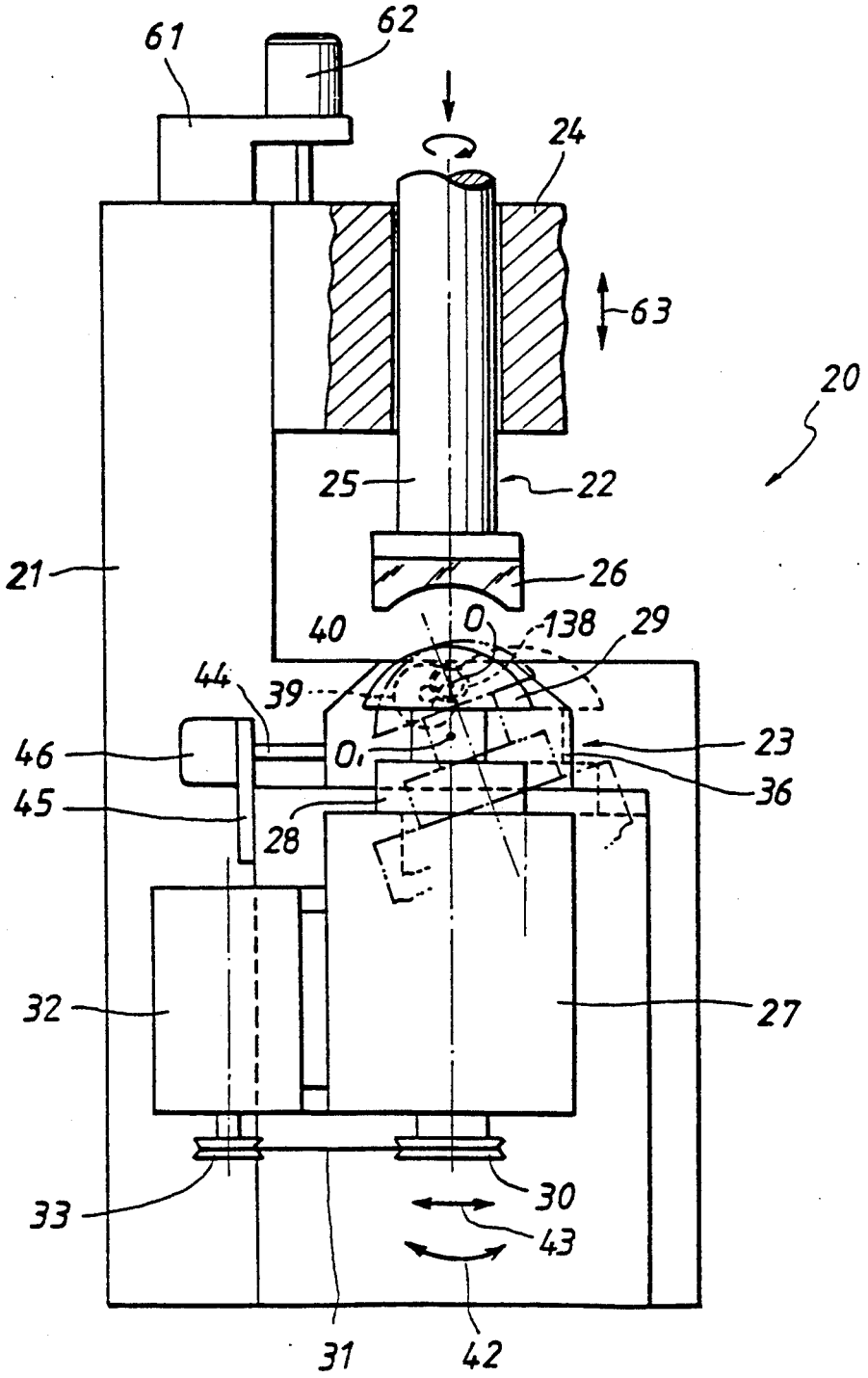
Figure 1:
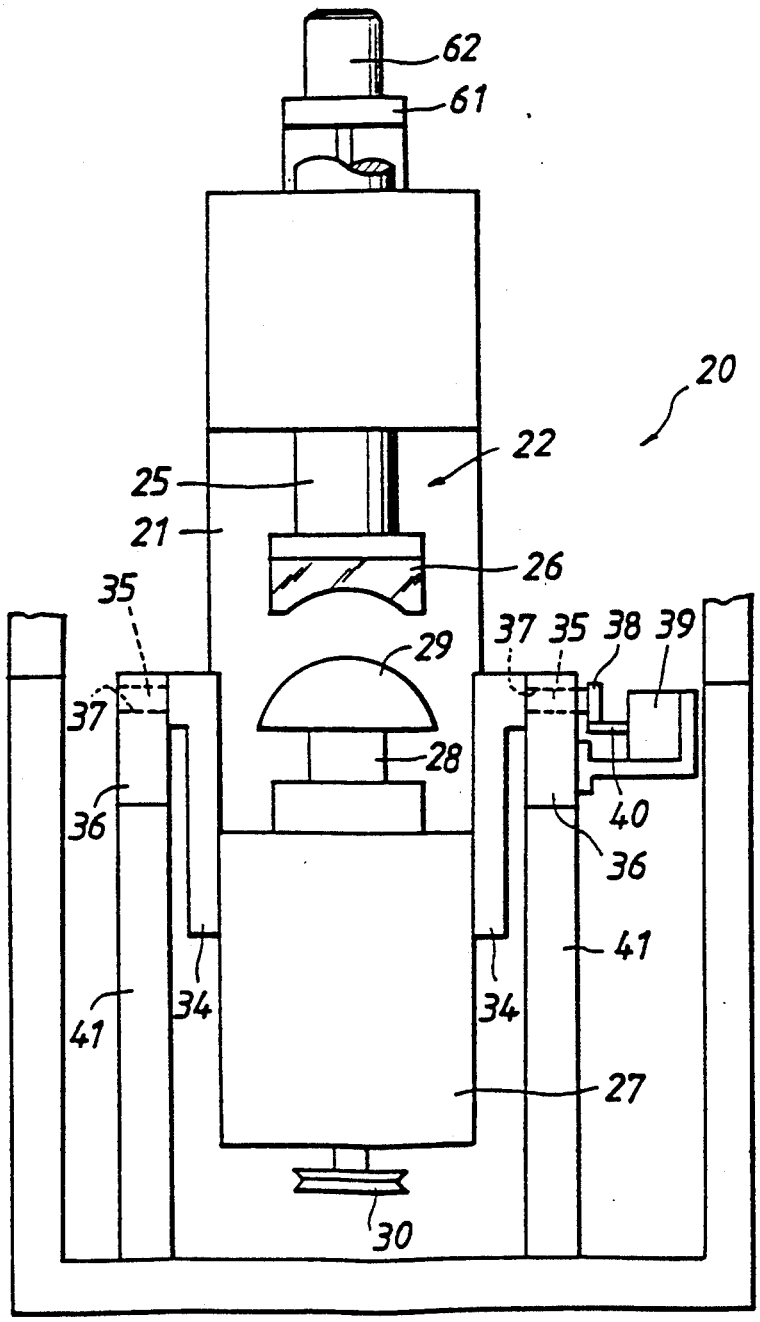
Figure 2:
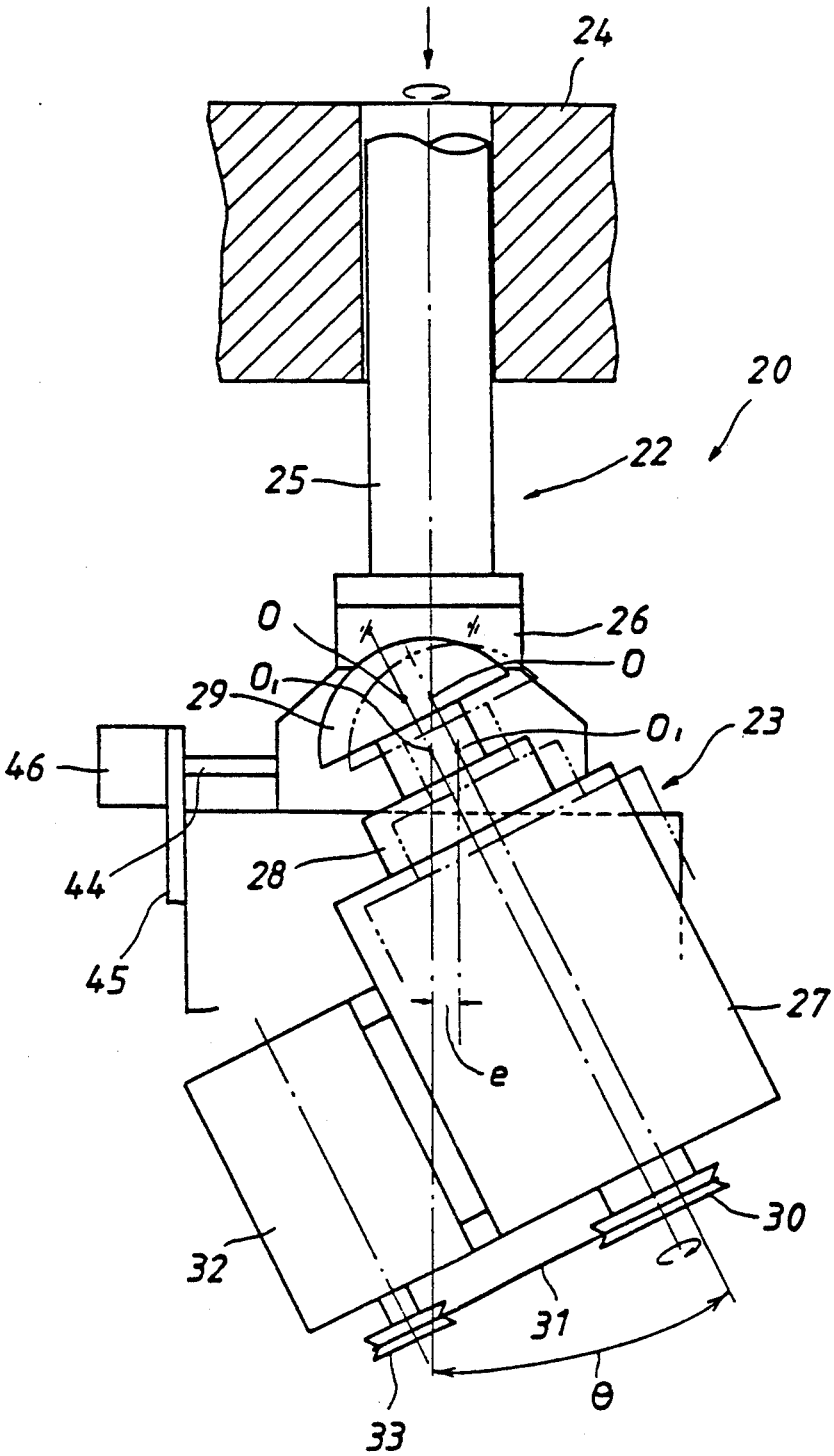
FIG. 2 is an explanatory view showing the action of the grinding and finishing apparatus shown in FIG. 1.
Figure 3:
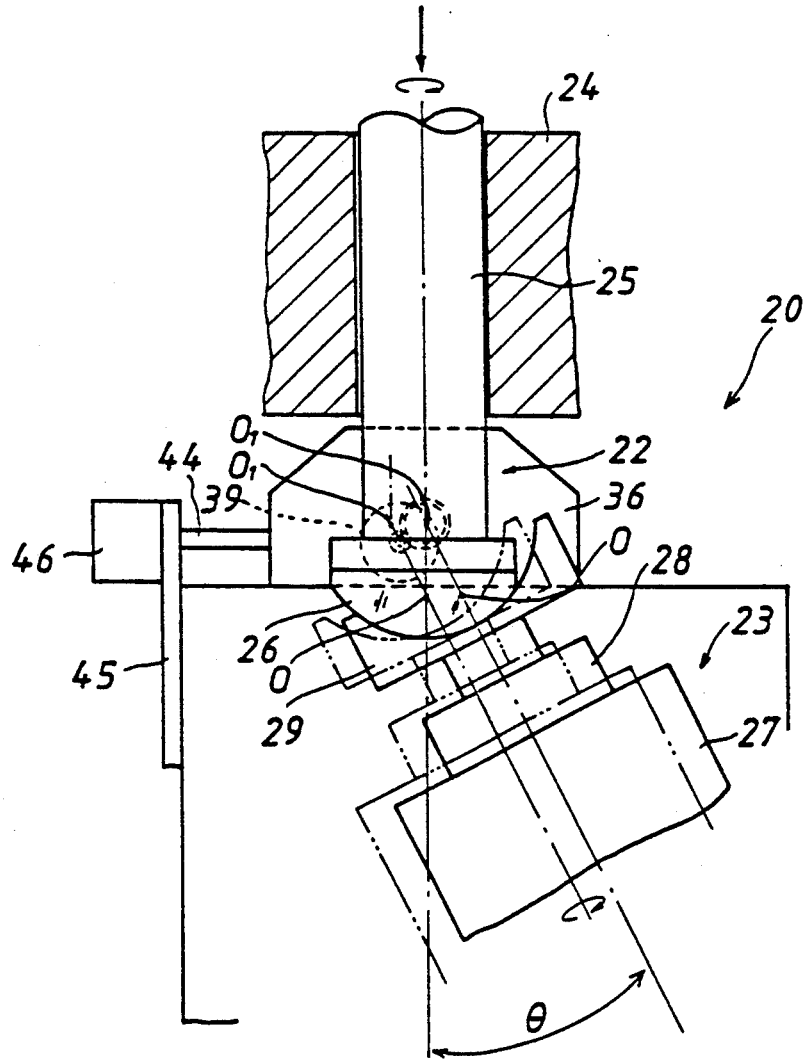
FIG. 3 is a side view showing a construction in another modification of the grinding and finishing apparatus shown in FIG. 1(*a*)

FIGS. 1 to 3 show one embodiment of the grinding and finishing apparatus 20 according to the present invention. FIG. 1*a* is a side view of the apparatus 20, FIG. 1*b* is a front view thereof, FIG. 1*c* is a side view showing a construction in modification of the apparatus shown in FIG. 1*a*, in which the holder is separated from the body of the apparatus, FIG. 1*d* is a front view thereof, and FIGS. 2 and 3 are explanatory views describing the action of the apparatus shown in FIG. 1.

As shown in FIG. 1, the grinding and finishing apparatus 20 comprises a body 21 thereof, a workpiece shaft section 22 mounted on the body 21, and a tool shaft section 23.

The workpiece shaft section 22 comprises a workpiece shaft 25 held on a holder 24 rotatably and slidably in the axial direction, and a workpiece 26 mounted on the lower end portion of the workpiece shaft 25. The holder 24 is constructed to the body 21 movably in the vertical direction.

The tool shaft section 23 comprises a tool shaft 28 held on a housing or support 27 rotatably, and a tool 29 fixed to the lower end portion of the tool shaft 28. A pully 30 is fixed to the tool shaft 28 of the tool shaft section 23. The pully 30 is so constructed that it is interlocked with a pully 33 provided on a driving device 32 through a belt 31. As shown in FIG. 1*b*, both side portions of the housing 27 for the tool shaft 28 are provided with arms 34 and upper portions of the respective arms 34 are fixed to or provided with horizontal swinging or swivel shafts 35 in an integrated body. The swinging shafts 35 of the respective arms 34 are respectively fitted into holes 37 formed in swivel holding bases 36, so that the tool shaft 28 may be swung about the swivel shaft 35 through the arms 34 and the swivel holding bases 36. The shaft end portion of one of the swivel shafts 35 is provided with a gear 38. This gear 38 is engaged with a gear 40 provided on a swivel servomotor 39. That is, the tool shaft 28 is so constructed that it may be driven and swung at an optional angle in the direction of an arrow 42 about a swivel center O through the servomotor 39 for swinging. The swivel holding base 36 is so constructed that it may be driven slidably in a horizontal direction, that is, in the direction of an arrow 43 through a slide base 41. A feed screw 44 is threaded into the swivel holding base 36 at its one end and connected with interlock at its other end to a servomotor 46 fixed to a holding member 45 which is mounted to the slide base 41. That is, the tool shaft 28 is so constructed that it may be moved controllably in the horizontal direction (rectilinear direction) 43 through the servomotor 46 and the feed screw 44.

These servomotors 39 and 46 are controlled by a numerical controlled unit (not shown), so that the tool shaft section 23 is operated in synchronism with the numerical control in the directions of arrows 42 and 43 and thus the tool shaft section 23 may be moved and controlled so as to always position the sphere center $O_1$ of the tool 29 on the axis of the workpiece shaft 25, even when the axis of the tool shaft 28 is inclined to the axis of the workpiece shaft 25.

In the grinding and finishing apparatus 20 thus constructed above, as shown in FIG. 2, grinding work is performed by angular amplitude swinging the tool shaft section 23 about the point O within the range of an angle $\theta$, so that when the tool shaft section 23 is swung about the point O, the sphere center $O_1$ of the tool shaft 28 is moved according to an inclination angle $\theta$ in the direction of an arrow 43 as shown in FIG. 1*a* by two dot-dash line. In this case, the moved amount e may be shown as $e=OO_1 \sin \theta$. The tool shaft section 23 is swung by an angle $\theta$ in the direction of the arrow 42 and is moved in the direction of the arrow 43 through the numerical controlled unit, so that the tool shaft section is corrected and controlled so as to position the sphere center $O_1$ of the tool 29 on the axis of the workpiece shaft 25. In this case, the direction of correction and control is determined by the position of the point $O_1$ relative to the point O. In this embodiment, such a correction and control is performed in synchronism with the continuous angular amplitude swinging with a control resolution necessary to contact in equal the workpiece 26 and the tool 29, so that the same working as the grinding work about the sphere center $O_1$ of the tool due to the angular amplitude swing can be performed. When the tool shaft section 23 translated in the direction of arrow 43 in accordance with the inclination angle $\theta$, the sphere center $O_1$ of the tool is shifted in the axial direction of the workpiece shaft 25 by $OO_1—OO_1 \cos \theta=OO_1 (1-\cos \theta)$. This shift may be absorbed by shifting the workpiece shaft 25 in the axial direction thereof, so that the working may be performed without any interferance.

When the workpiece shaft 25 is moved in the holder 24 in its axial direction, if a sliding resistance is present between the workpiece shaft 25 and its holder 24, scatter in working pressure between the workpiece (lens material to be ground) 26 and the tool 29 is produced and thus the workpiece 26 can not be ground uniformly. In this case, as shown in FIGS. 1*c* and 1*d*, the holder 24 is separated from the body 21 of apparatus and is controlled movably in the axial direction of the workpiece shaft 25 by a numerical controlled unit (not shown) through a servomotor 62 fixed to a bracket 61 which is mounted to the body 21. For the movement or shift in the axial direction of the workpiece shaft 25 due to the shift $OO_1 (1-\cos \theta)$ of the sphere center $O_1$ of the tool, the movement of the holder 24 is controlled in synchronism with the angular amplitude swinging 42 and the translating movement 43 of the tool shaft 28 through the servomotor 62, so that the relative sliding resistance is not caused between the holder 24 and the workpiece shaft 25, and the working pressure may be uniform between the workpiece 26 and the tool 29, thereby obtaining the workpiece with stable quality.

According to the above embodiment, even when the tool shaft section 23 is swung about the point O, the same working as the grinding work due to the angular amplitude swing about the sphere center $\theta_1$ of the tool may always be performed, so that sphere center swinging work may be performed while holding the center line of the workpiece shaft and the center line of the workpiece coaxially without coincidence of a swivel center O of the angular amplitude swinging of the tool shaft 28 with the sphere center $O_1$ of the tool. Even when the radius of curvature of the workpiece 26 and the tool 29 is changed to another combination, the working conditions may easily be set by inputting the range of the angular amplitude swing $\theta$, the distance between the swivel center O of the tool shaft 28 and the sphere center $O_1$ of the tool, the discrimination of sperical surface in unevenness of the tool 29, and the swinging rate into the numerical controlled unit. That is, for example, the following work conditions may be inputted. As the swinging angle $\theta$, minimum angle $\theta_1=10$ (deg), maximum angle $\theta_2=25$ (deg), as the distance $OO_1$ between the tool shaft swivel center O and the tool sphere center $O_1$, $OO_1=10.000$ (mm), as the discrimination of spherical surface in unevenness, the convex surface of the tool is + sign, and as the swinging rate $\omega$, $\omega=0.5$ (rad/sec).

According to the present invention, by setting such condition, the grinding work of the surface to be worked of the workpiece having all radii of curvature (all configuration) from very small radius of curvature to the plane surface may be advantageously performed without coincidence of the swivel center O of the angular amplitude swinging of the tool shaft 28 with the tool sphere center $O_1$ so that the grinding and finishing apparatus may be utilized effectively, and thus the apparatus may be obtained with simplicity, smallness in size, easiness in use, reliability and durability.

The above embodiment describes the workpiece 26 having a concave surface and the tool 29 having a convex surface. However, the workpiece 26 may have a convex surface and the tool 29 may have a concave surface. Such an embodiment is shown in FIG. 3 in which respective components, action and advantageous effect are the same as those in FIGS. 1*a*~1*d*, so that the reference numerals designating corresponding parts are the same as those in FIGS. 1*a*~1*d* and its explanation is omitted.

In the above embodiment, the tool shaft section 23 is arranged at the swivel side thereof, but the workpiece shaft section 22 and the tool shaft section 23 may be exchanged to each other, so that even through the workpiece shaft section 22 may also be arranged at the swivel side thereof, the same working and advantageous effect may be obtained.

FIGS. 4*a*~4*d* show second embodiment of the grinding and finishing apparatus 20 according to the present invention. In this embodiment, the angular amplitude swinging operation in the direction of arrow 42 as in the first embodiment is performed at the tool shaft section 23 and the translation or rectilinear moving operation in the direction of arrow 43 is performed at the workpiece shaft section 22. That is, the holder 24 for the workpiece shaft 25 is constructed movably in the direction of arrow 43 to the body 21 of the apparatus, and the holder 24 is controlled movably in the direction of arrow 43 through a servomotor 52 having a ballscrew 51 threaded into a movable actuator 50 which is provided to the lower portion of the holder 24. Reference numeral 53 is a sliding portion. The movement of the holder 24 is so controlled that the axial center of the workpiece shaft 25 is always passed through the sphere center $O_1$ of the tool in synchronism with the movement of the tool sphere center $O_1$ at the angular amplitude swing of the tool shaft section 23 as in the first embodiment. The workpiece shaft section 22 is also moved in the direction of arrow 43 so that the tool shaft section 23 may only be swung with angular amplitude within the range of a given inclined angle $\theta$ in contrast to the first embodiment. Other construction is the same as that of the first embodiment, so that the reference numerals designating corresponding parts are the same as those in FIGS. 1*a*~1*d* and its explanation is omitted.

In order to perform the grinding work in this embodiment, the workpiece shaft 25 is descended to contact the workpiece 26 to the tool 29 and then the tool shaft section 23 is swung with angular amplitude about the point O within the range of inclind angle $\theta$ while rotating the tool shaft 28 and/or the workpiece shaft 25. In this case, the movement of the workpiece shaft 25 is controlled according to the inclined angle of the tool shaft section in the direction of arrow 43 and then, the axial center of the workpiece shaft 25 is always passed through the sphere center $O_1$ of the tool in synchronism with the movement in the horizontal direction of the tool sphere center $O_1$, so that the same working as the grinding work due to the angular amplitude swinging about the tool sphere center $O_1$ may be obtained as in the first embodiment.

Figure 4:
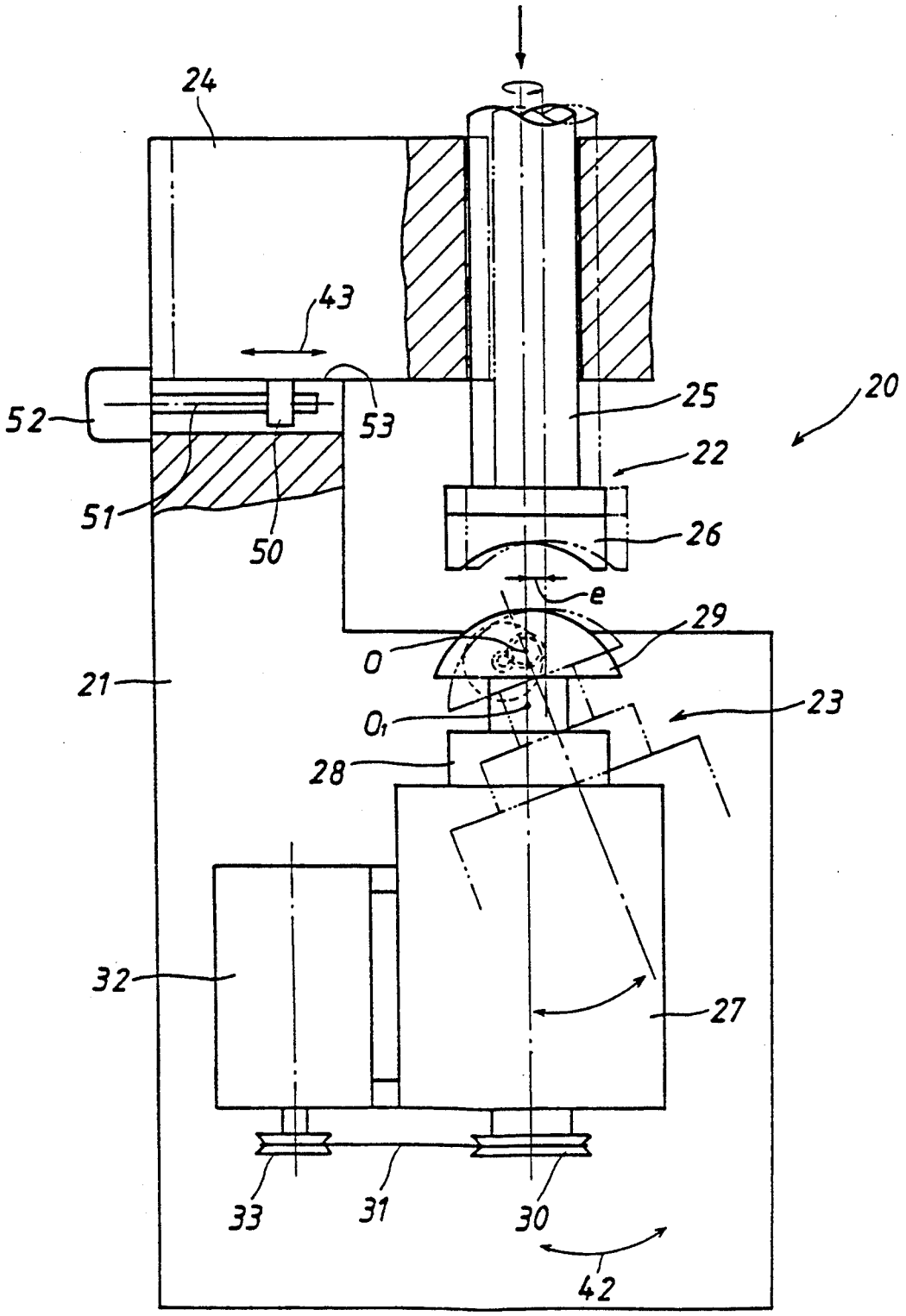
FIGS. 4*a* and 4*b* are side view and front view each showing a construction of another embodiment of a grinding and finishing apparatus according to the present invention.
FIGS. 4*c* and 4*d* are a side view and a front view each showing a construction in modification of the grinding and finishing apparatus according to the present invention.
Figure 4:
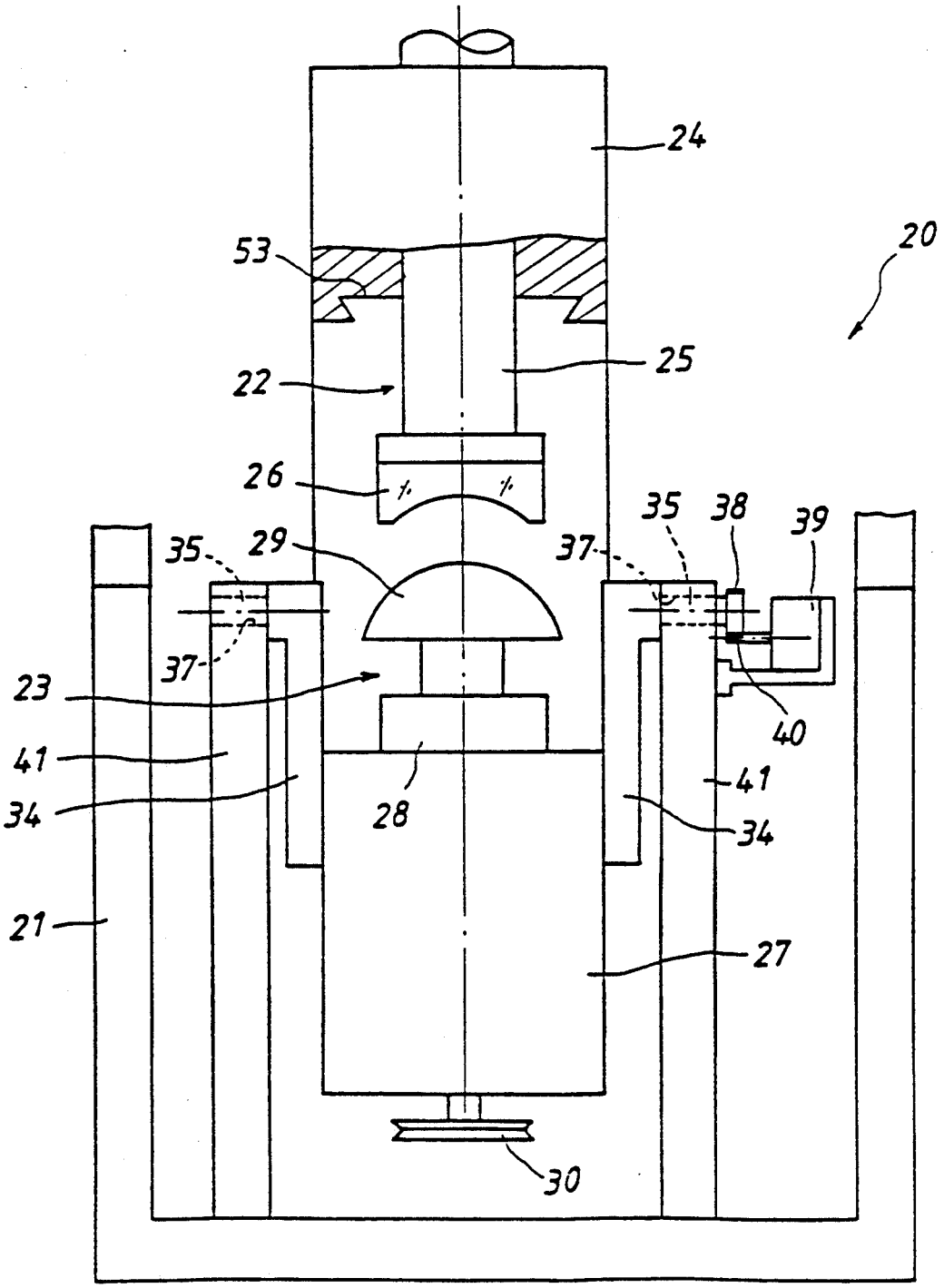
Figure 4:
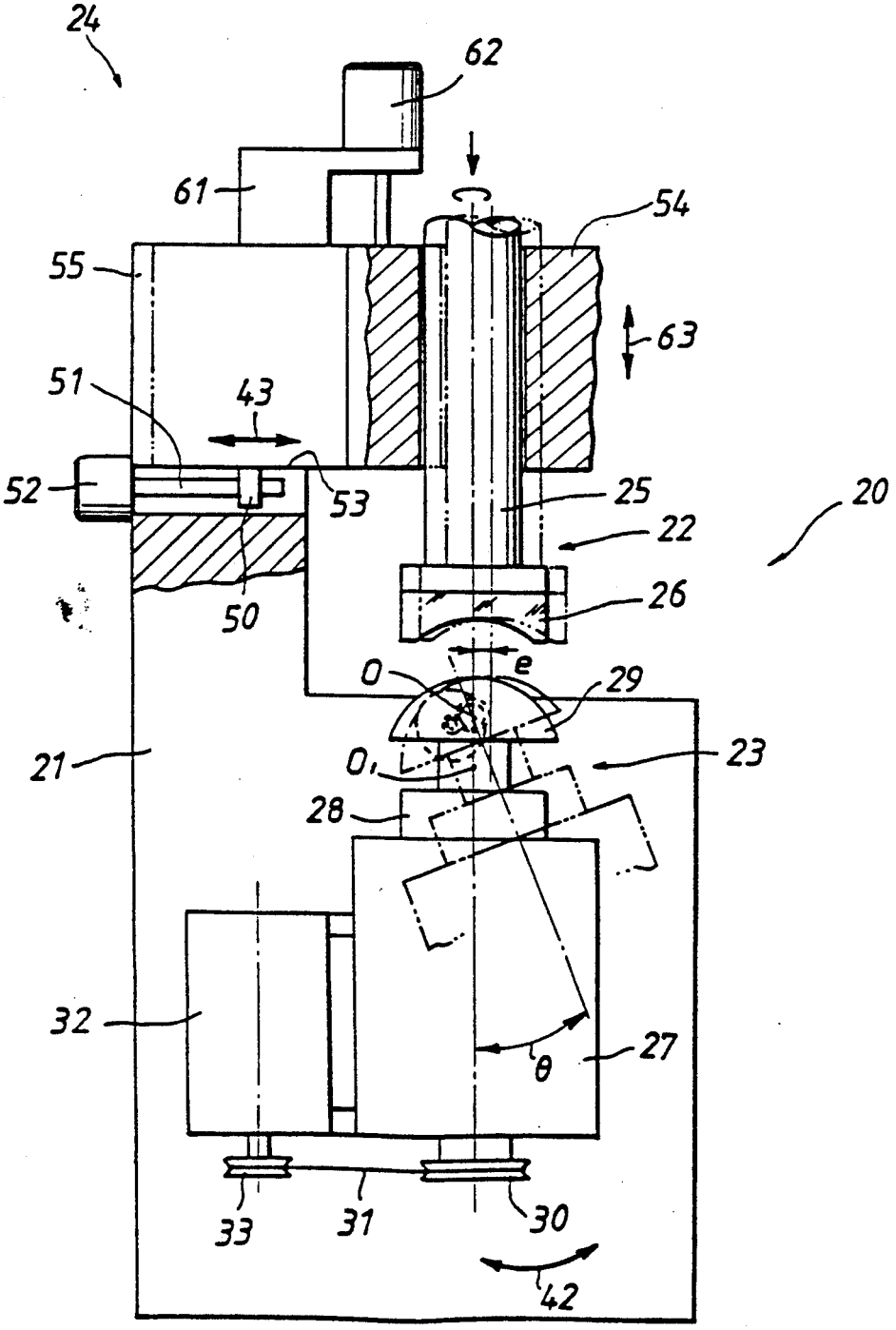
Figure 4:
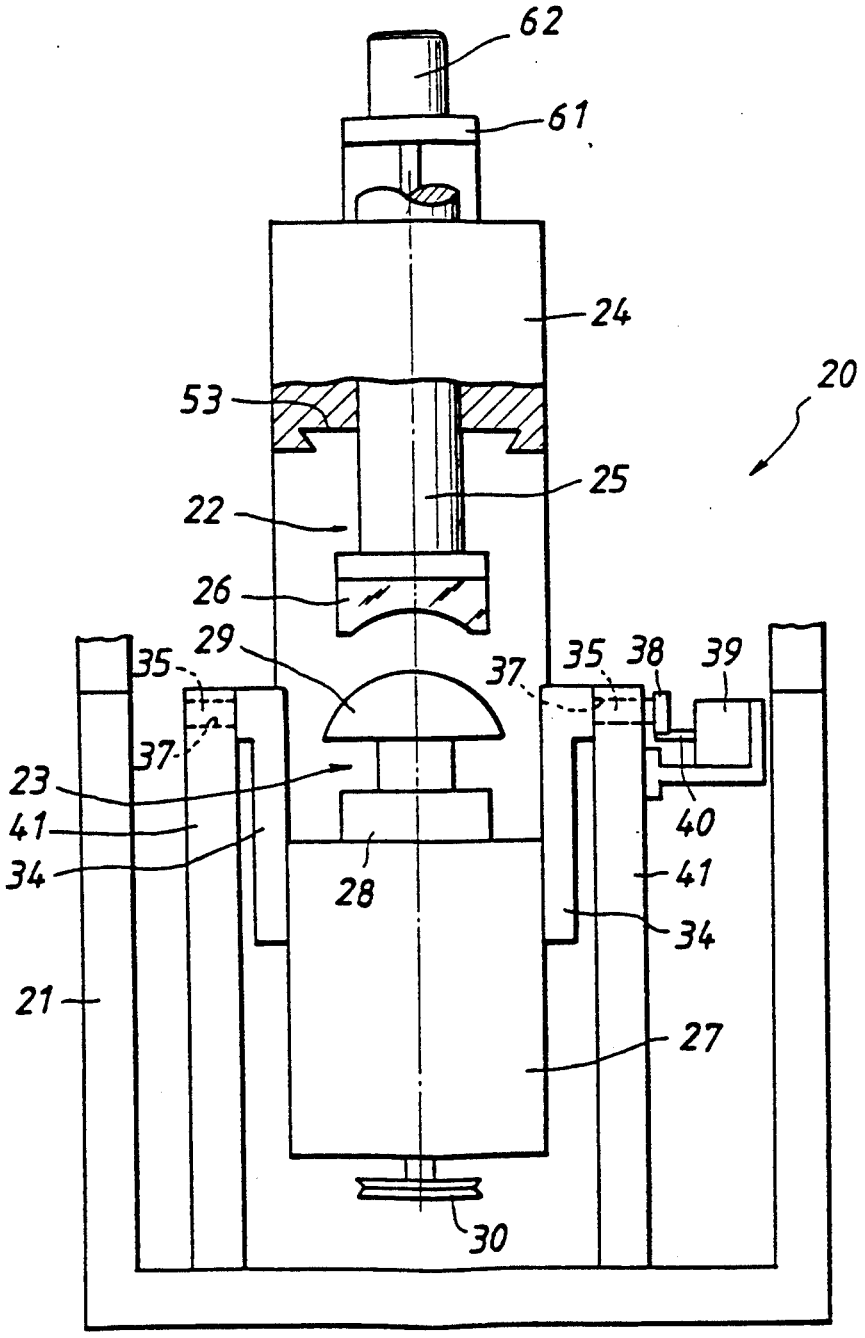

Particularly, when the sliding resistance is caused between the workpiece shaft 25 and the holder 24, as shown in FIGS. 4*c* and 4*d*, the holder 24 is separated into two members, that is, a guide member 54 for guiding the workpiece shaft 25 and a holding member 55 for holding the guide member 54, the holding member 55 is fixed to the bracket 61, and the guide member 54 is controlled movably by the servomotor 62.

According to this embodiment shown in FIGS. 4*c* and 4*d*, therefore, there is the additional advantageous effect that the driven section of the grinding and finishing apparatus 20 may be divided into two portions, that is, the workpiece shaft section 22 and the tool shaft section 23 so that the apparatus has advantage in construction and function.

In the present embodiment, the tool shaft section 23 is arranged at its swivel side. Even when the workpiece shaft 22 is arranged at its swivel side by exchanging the workpiece shaft section 22 and the tool shaft section 23 with each other, the same working advantageous effect may be obtained.

Figure 5A:
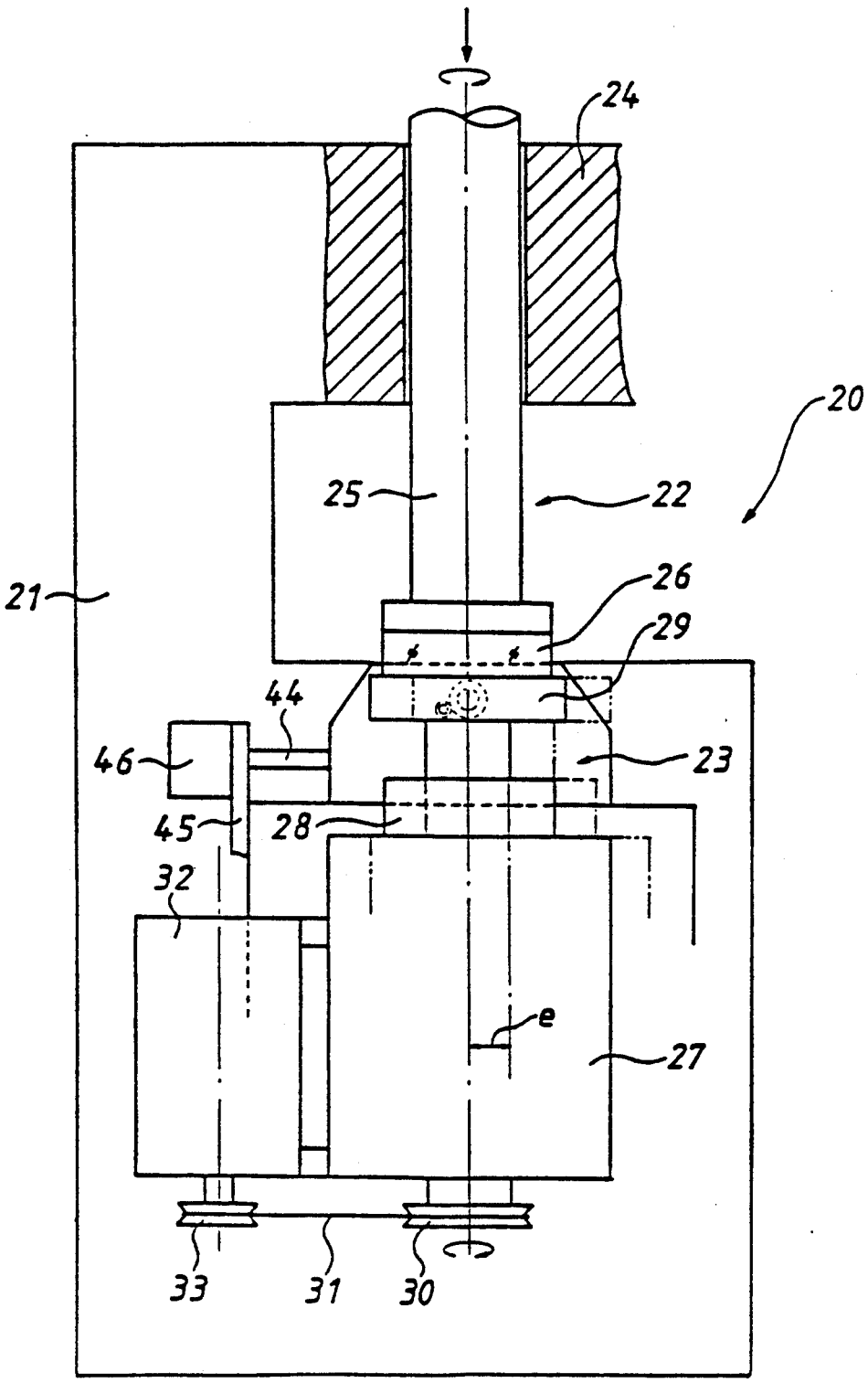
FIGS. 5*a* is a side view showing a of construction of a further embodiment of a grinding and finishing apparatus according to the present invention.
Figure 5:
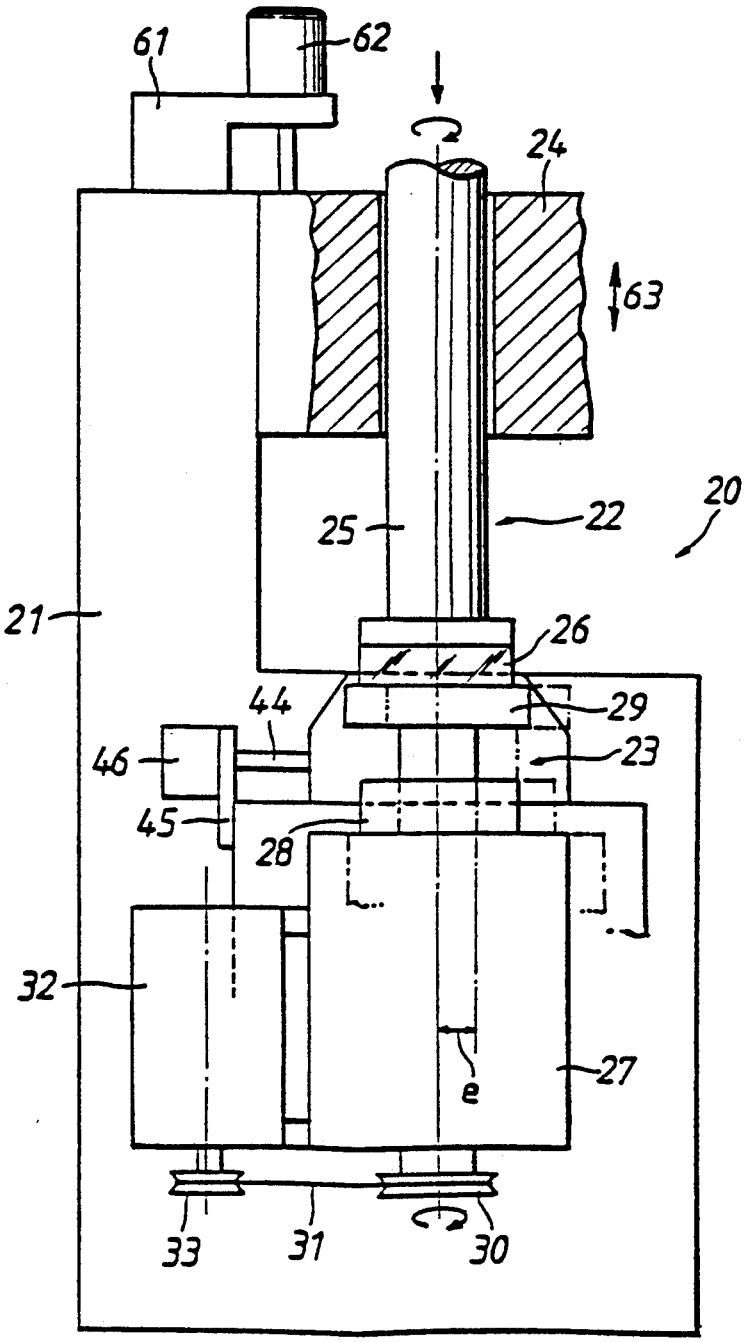
FIG. 5*b* is a side view showing a construction in modification of the grinding and finishing apparatus shown in FIG. 5*a;*

FIGS. 5*a* and 5*b* show a third embodiment of the grinding and finishing apparatus 20 according to the present invention. This embodiment shows the case of grinding a plane surface of the workpiece. In this embodiment, as shown in FIGS. 5*a* and 5*b*, the tool shaft section 23 is controlled with rectilinear moving in the horizontal direction by the servomotor 46. The moving mechanism of the tool shaft section by the servomotor is the same as that shown in FIG. 1*a* so that its explanation is omitted. In this embodiment, the angular amplitude swinging is not required so that the mechanism for the angular amplitude swinging may be omitted or the swinging drive control may not be performed. This embodiment shows an example of moving the tool shaft section 23, but the workpiece shaft section 22 may be moved. Other construction is the same as that of the first embodiment, so that reference numerals designating corresponding parts are the same as those in FIG. 1*a* and its explanation is omitted.

In this embodiment, the workpiece 26 is contacted to the tool 29, and the tool shaft section 23 or the workpiece shaft section 22 is given a rectilinear reciprocating motion by a shifting amount e necessary to the working while rotating the tool shaft 28 and/or the workpiece shaft 25, so that the grinding working for plane surface of the workpiece may be performed.

In this embodiment, the workpiece shaft section 22 and the tool shaft section 23 may be exchanged, thereby obtaining the same working and effect.

In addition to the above embodiments, when the workpiece 26 and the tool 29 have a spherical surface, respectively, and the apparatus is so arranged that the tool sphere center $O_1$ corresponds with the swivel center O of the angular amplitude swinging thereof, the grinding work may be performed only by the angular amplitude swinging of the tool shaft 28. Also, the construction of the apparatus shown in the first to third embodiments may be inverted upside-down. In this case, the same function can be obtained.

The above respective embodiments explained the example of grinding the optical element, but the present invention is not limited to the optical element and may be applied to the grinding working of the spherical bearing surface or the like of ceramics, metals and plastics.

According to the above respective embodiments, provision is made of angular amplitude swinging mechanism of the workpiece shaft or the tool shaft, and rectilinear moving mechanism of the workpiece shaft or the tool shaft, so that the same working as the grinding work by the angular amplitude swinging about the sphere center of workpiece or tool may be performed.

Moreover, when the angular amplitude swinging mechanism is not performed and the rectilinear moving mechanism is only performed, the grinding work for the plane surface of the workpiece may be performed.

As described above, according to the present invention, all kinds of surfaces from the spherical surface having very small radius of curvature to the plane surface may be ground.

The above embodiments show an example of the grinding and finishing apparatus, but the present invention may be applied to the spherical surface generating work utilizing a straight cup grinding wheel.

Figure 6:
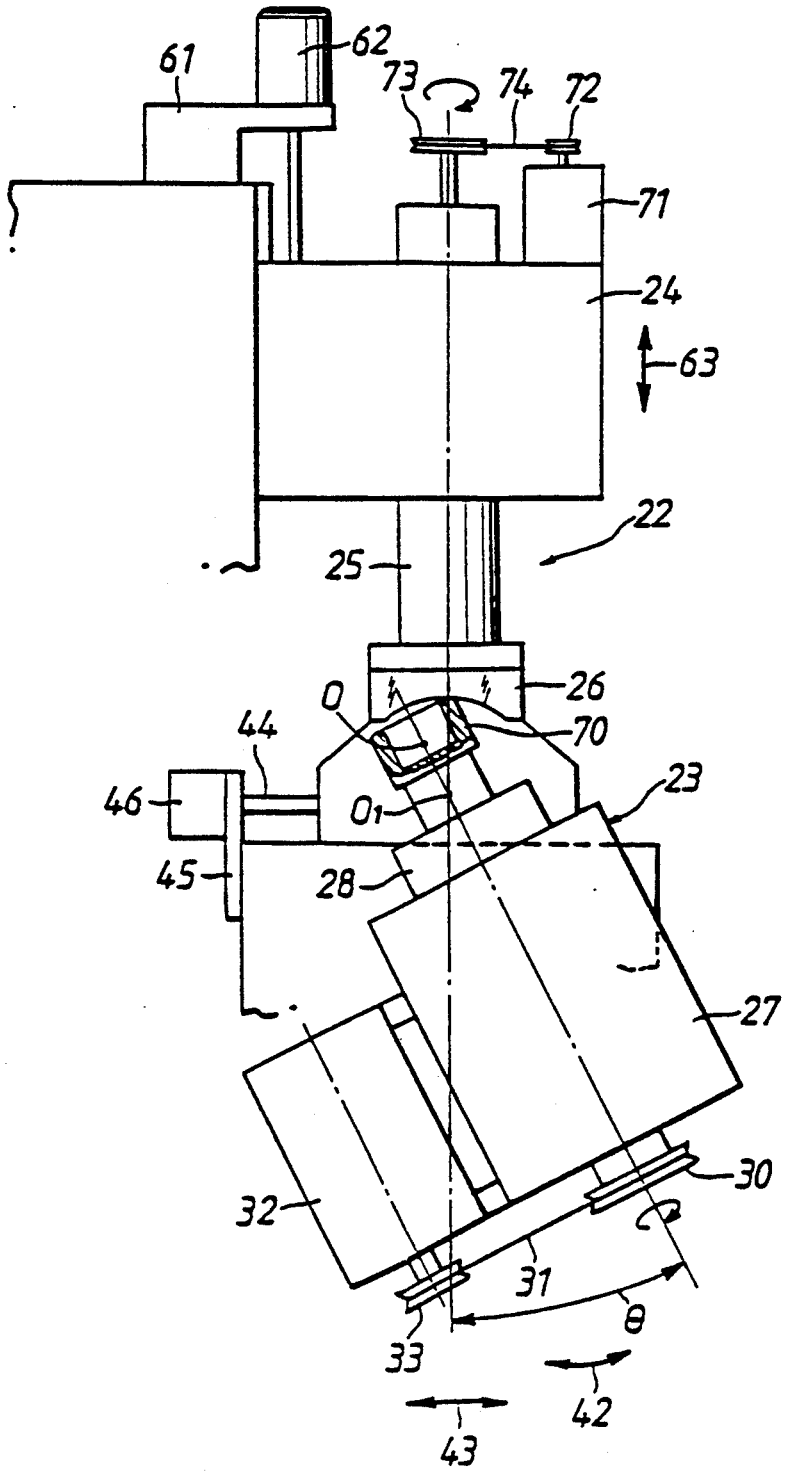
FIG. 6 is a side view showing a construction of an apparatus for carrying out a grinding and finishing method according to the present invention.
Figure 7:
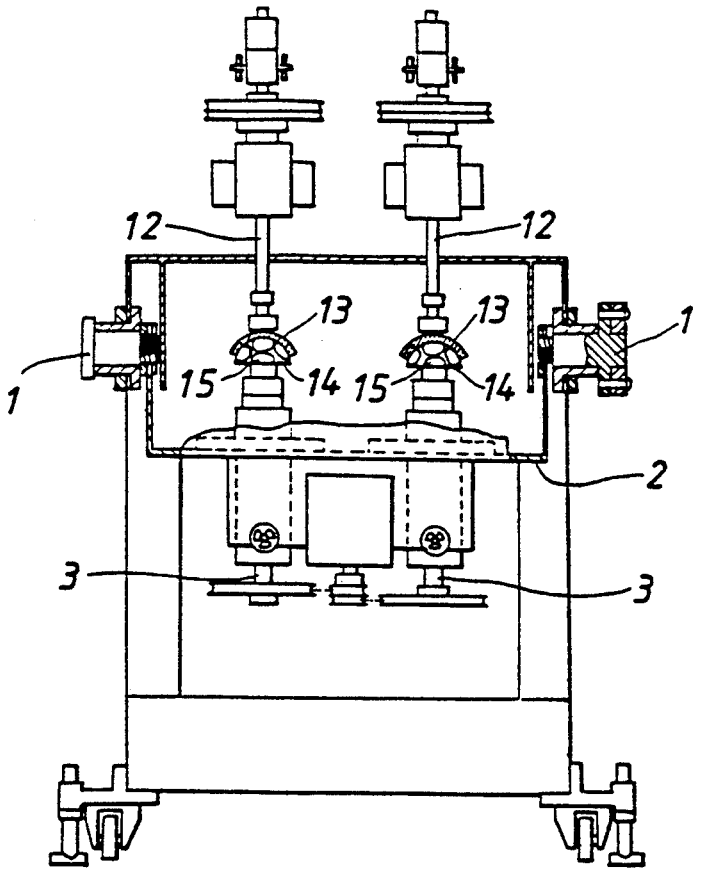
FIGS. 7 and 8 are a front view and a side view each showing a construction of the conventional grinding and finishing apparatus.
Figure 8:
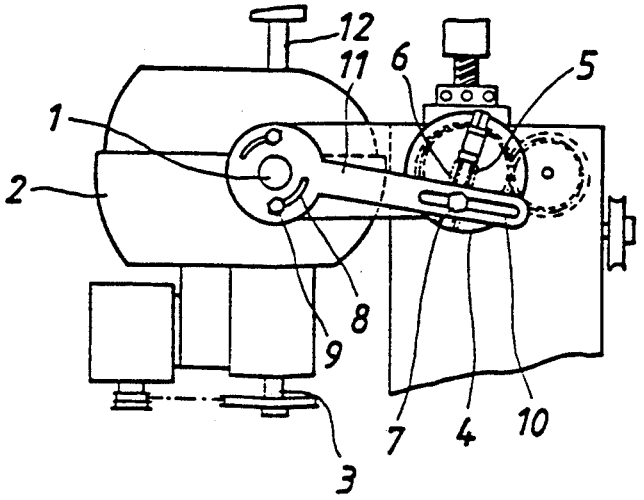

FIG. 6 shows an apparatus for carrying out a grinding and finishing method according to the present invention. The present embodiment shows an example of grinding and generating a sperical surface based on a spherical surface generating principle by utilizing a straight cup grinding wheel.

In this embodiment, a pully 73 is rigidly secured to the upper end portion of the workpiece shaft 25, and a belt 74 is wound between the pully 73 and a drive pully 72 provided to a drive motor 71 which is fixed to the holder 24, so that the workpiece shaft 25 may be rotated by driving it through the motor 71. The workpiece shaft 25 may also be controlled movably in its axial direction together with the holder 24 through a servomotor 62. A straight cup grinding wheel 70 is secured to the tip portion of the tool shaft 28. Other construction is the same as that of the first embodiment, so that reference numerals designating corresponding parts are the same as those in the first embodiment and its explanation will be omitted.

According to the present embodiment, the angle $\theta$ of the tool shaft 28 and the movement thereof in the horizontal direction 43 are adjusted and the movement of the workpiece shaft 25 in the axial direction 63 is controlled by the servomotor 62 while rotating the workpiece shaft 25 by the motor 71, thereby grinding and working the workpiece 26. In addition to the working by the swinging of the straight cup grinding wheel 70 as shown in the present embodiment, the cup grinding wheel 70 and the workpiece 26 are relatively driven while holding a given positional relation, thereby grinding the workpiece 26 with relative cutting.

The present embodiment shows an example of grinding and generating the spherical surface by the straight cup grinding wheel 70, but the working with a dish grinding wheel may be performed by using the dish grinding and finishing wheel having a spherical surface and a plane surface forming a concave and a convex pair for the spherical surface and the plane surface of the workpiece 26 instead of the straight cup grinding wheel.

According to the present embodiment, workings from the grinding generation to the grinding and finishing are performed in the same apparatus by the selection of grinding wheels, the selection of rotative driving of the tool shaft 28 and the workpiece shaft 25, and the setting of numerical controlled program.

In this embodiment, also, the workpiece shaft section 22 and the tool shaft section 23 may be exchanged, and the effect may also be obtained.

The above described embodiments show examples of grinding and finishing the spherical surface and the plane surface. Even in any embodiment, the movement of three control shafts is controlled continuously or intermittently in synchronism with each other in order to obtain a desired form or shape, so that the same working as that of the above described embodiments may be performed by carrying out the movable control preferred to its shape even when the workpiece has an aspheric surface (elliptic surface, toric surface, parabolic surface, or the like).

What is claimed is:

1. In a grinding and finishing apparatus having a workpiece shaft for carrying a workpiece so as to rotate the workpiece about its axis, and a tool shaft for carrying a tool having a sphere center on the same axis as that of the workpiece shaft and capable of being rotationally driven through a driven means to effect grinding and finishing of the workpiece by rotating the workpiece and the tool with each other: a holder for slidably holding the workpiece shaft thereon; a swivel shaft positioned between the sphere center and the workpiece held on the workpiece shaft thereby defining a swivel center which intersects perpendicularly to the workpiece shaft; a mechanism for angularly swinging the tool shaft about the swivel shaft so as to coincide the sphere center of the tool with the shaft center of the workpiece shaft by the swinging of the tool shaft; and a mechanism for translating the tool shaft in a direction perpendicular to the respective shaft centers of the workpiece shaft and the swivel shaft.

2. A grinding and finishing apparatus as claimed in claim 1; including a mechanism connected to the holder for moving the holder in the axial direction of the workpiece shaft in synchronism with the sliding of the workpiece shaft.

3. A grinding and polishing apparatus as claimed in claim 2; wherein the tool comprises a cup-shaped wheel.

4. A grinding and polishing apparatus as claimed in claim 1; wherein the tool comprises a cup-shaped wheel.

5. In a grinding and finishing apparatus having a workpiece shaft for carrying a workpiece so as to rotate the workpiece about its axis, and a tool shaft for carrying a tool having a sphere center on the same axis as that of the workpiece shaft and capable of being rotationally driven through a driven means to effect grinding and finishing of the workpiece by rotating the workpiece and the tool with each other: a holder for slidably holding the tool shaft thereon; a swivel shaft positioned between the sphere center and the tool held on the tool shaft thereby defining a swivel center which intersects perpendicularly to the tool shaft; a mechanism for angularly swinging the workpiece shaft about the swivel shaft so as to coincide the sphere center of the workpiece with the shaft center of the tool shaft by the swinging of the workpiece shaft; and a mechanism for translating the workpiece shaft in a direction perpendicular to the respective shaft centers of the tool shaft and the swivel shaft.

6. A grinding and finishing apparatus as claimed in claim 5; including a mechanism connected to the holder for moving the holder in the axial direction of the tool shaft in synchronism with the sliding of the tool shaft.

7. A grinding and finishing apparatus as claimed in claim 6; wherein the tool comprises a cup-shaped wheel.

8. A grinding and finishing apparatus as claimed in claim 5; wherein the tool comprises a cup-shaped wheel.

9. An apparatus for grinding a workpiece comprising: a rotatable workpiece shaft for carrying a workpiece to be ground so as to rotate the workpiece about a center axis thereof, the workpiece shaft having a longitudinal center axis; a rotatable tool shaft for carrying a tool having a curved grinding surface with a center of curvature lying on the center axis of the workpiece shaft; means for axially displacing the workpiece shaft relative to the tool shaft; first means mounting the tool shaft and the workpiece shaft for lateral movement relative to one another; second means mounting the tool shaft for swinging movement about a swing axis extending perpendicular to and intersecting the center axis of the workpiece shaft; and means for swinging the tool shaft about the swing axis in synchronism with lateral movement of the tool shaft and the workpiece shaft relative to one another so as to maintain the center of curvature of the tool grinding surface on the center axis of the workpiece shaft during grinding of the workpiece.

10. An apparatus according to claim 9; wherein the second means comprises a support for rotatably supporting the tool shaft, and means mounting the support for swinging movement about the swing axis; and the first means comprises means mounting the support for lateral movement relative to the the workpiece shaft.

11. An apparatus according to claim 10; wherein the means mounting the support for swinging movement comprises a swivel shaft mounted to undergo swinging movement about the swing axis, and means connecting the swivel shaft to the support whereby swinging movement of the swivel shaft effects corresponding swinging movement of the support and tool shaft.

12. An apparatus according to claim 11; wherein the means mounting the support for lateral movement comprises a slidable base swingably carrying thereon the swivel shaft and mounted to undergo sliding movement in the lateral direction relative to the workpiece shaft.

13. An apparatus according to claim 12; wherein the means for swinging the tool shaft comprises a drive motor, and means connecting the drive motor to the swivel shaft to effect swinging movment of the swivel shaft accompanied by swinging movement of the support and tool shaft.

14. An apparatus according to claim 13; wherein the means for laterally moving the tool shaft and the workpiece shaft relative to one another comprises a drive motor connected to effect sliding movement of the base in the lateral direction accompanied by lateral movement of the support and tool shaft.

15. An apparatus according to claim 11; wherein the means for swinging the tool shaft comprises a drive motor, and means connecting the drive motor to the swivel shaft to effect swinging movment of the swivel shaft accompanied by swinging movement of the support and tool shaft.

16. An apparatus according to claim 9; including a holder for slidably holding the workpiece shaft to permit the same to undergo axial displacement toward and away from the tool shaft, and means for axially displacing the holder in the axial direction of the workpiece shaft.

17. An apparatus according to claim 9; wherein the first means comprises a slidable holder rotatably holding the workpiece shaft and mounted to undergo sliding movement in the lateral direction to effect lateral movement of the workpiece shaft relative to the tool shaft.

18. An apparatus according to claim 17; wherein the means for laterally moving the tool shaft and the workpiece shaft relative to one another comprises a drive motor connected to effect sliding movement of the holder in the lateral direction accompanied by lateral movement of the workpiece shaft.

* * * * *